US006551054B1

(12) United States Patent
Peltonen et al.

(10) Patent No.: US 6,551,054 B1
(45) Date of Patent: Apr. 22, 2003

(54) METHOD AND APPARATUS FOR PUMPING A MATERIAL AND A ROTOR FOR USE IN CONNECTION THEREWITH

(75) Inventors: Kari Peltonen, Karhula (FI); Reijo Vesala, Kotka (FI); Vesa Vikman, Kymi (FI)

(73) Assignee: Sulzer Pumpen AG, Winterthur (CH)

( * ) Notice: Subject to any disclaimer, the term of this patent is extended or adjusted under 35 U.S.C. 154(b) by 0 days.

(21) Appl. No.: 09/869,375

(22) PCT Filed: Dec. 28, 1999

(86) PCT No.: PCT/FI99/01086

§ 371 (c)(1),
(2), (4) Date: Aug. 6, 2001

(87) PCT Pub. No.: WO00/43677

PCT Pub. Date: Jul. 27, 2000

(30) Foreign Application Priority Data

Dec. 30, 1998 (FI) ..... 982829

(51) Int. Cl.[7] ..... F01D 5/00

(52) U.S. Cl. ..... 415/72; 415/1; 415/143; 415/169.1; 416/176

(58) Field of Search ..... 415/1, 143, 169.1, 415/72, 74; 416/176, 177

(56) References Cited

U.S. PATENT DOCUMENTS 4,410,337 A 10/1983 Gullichsen et al.
4,435,193 A 3/1984 Gullichsen et al.
4,770,604 A * 9/1988 Luthi et al. ..... 415/62
4,877,368 A 10/1989 Timperi et al.
4,884,943 A * 12/1989 Niskanen ..... 415/143
4,971,519 A 11/1990 Timperi
5,000,658 A * 3/1991 Niskanen ..... 415/143
5,114,310 A 5/1992 Haavik et al.
5,152,663 A 10/1992 Peroaho et al.
5,462,585 A 10/1995 Niskanen et al.
5,575,559 A * 11/1996 Roll ..... 366/171.1
5,615,997 A * 4/1997 Hoglund et al. ..... 415/169.1
6,036,749 A * 3/2000 Riberiro et al. ..... 95/261
6,071,331 A * 6/2000 Niskanen et al. ..... 96/213
6,113,675 A * 9/2000 Branstetter ..... 95/261

FOREIGN PATENT DOCUMENTS

CH 606804 A5 11/1978
EP 0330387 A2 9/1989

* cited by examiner

*Primary Examiner*—Edward K. Look
*Assistant Examiner*—J. M. McAleenan
(74) *Attorney, Agent, or Firm*—Nixon & Vanderhye P.C.

(57) ABSTRACT

A method and apparatus is disclosed for pumping a material, especially thick, gas-containing, fiber suspensions for wood processing. The apparatus includes a centrifugal pump with a rotor having blades twisted such that the pitch of the blade changes along the length of the rotor.

37 Claims, 4 Drawing Sheets

METHOD AND APPARATUS FOR PUMPING A MATERIAL AND A ROTOR FOR USE IN CONNECTION THEREWITH

This application is the U.S. national phase of international application 1086 filed PCT/FI/01086, and filed Dec. 28, 1999 which designated U.S.

BACKGROUND AND SUMMARY OF THE INVENTION

The present invention relates to an improved method and apparatus for pumping liquids or various suspensions. The method, apparatus and rotor used in connection therewith are especially preferably suitable for pumping fiber suspensions of the paper and pulp industry at medium consistency (8–20%) and high consistency (over 20%). According to a preferred embodiment of the invention the method, apparatus and rotor used in connection therewith are suitable for pumping viscous and/or air-containing mediums. The method invention mainly relates to intensifying the pumping of liquids or various suspensions, but also to methods of eliminating the disadvantages caused by air and/or gases existing in and being absorbed into said medium. Especially the invention of the apparatus relates preferably to a construction utilized in connection with a centrifugal pump in order to increase the inlet pressure of the pump.

Prior art knows a large amount of centrifugal pumps that have been and still are used for pumping the fiber suspensions in the wood processing industry. The biggest group is presented by centrifugal pumps having a conventional basic construction with some in-essential changes therein to make them capable of pumping pulp. As an example of this kind of changes, e.g. mounting so-called inducers in front of the actual impeller for facilitating the flow of the pulp to the actual impeller of the pump may be stated. Despite many attempts and minor constructional changes, pumps of the described type are hardly capable of pumping a pulp at a consistency above 6–8%. The reason for this is both the increasing air content of the pulp as the consistency increases, whereby the air or gas bubble accumulated in the center of the impeller prevents the pulp from passing to the impeller, and the poor flow properties of thick pulp in the suction duct of the pump or from the pulp-containing space into the suction duct of the pump.

The second stage, entering the market in the late 1970-'s, was the so-called MC™ pump characterized in that in the inlet opening of the pump there is arranged a rotor most usually extending through the suction duct to some extent into the pulp container, the drop leg or the like, by means of which rotor bonds between fibers of the fiber suspension are being loosened by feeding energy in form of a shear force field into the pulp, whereby the flow of the pulp to the impeller of the pump is facilitated. The objective of these pumps was to make it possible to pump pulps at the consistency of 8–15%. The main problem was considered to be the poor flow properties of pulp at said consistency in the suction duct of the pump, due to which fact the invention was at that time related to methods of getting the pulp to flow in the suction duct of the pump to the impeller. Various embodiments of this kind of pump are described e.g. in U.S. Pat. Nos. 4,410,337, 4,435,193 and 4,637,779. All said solutions are characterized in that they both fluidize the pulp being pumped and remove therefrom gas, most usually air, that disturbs both the pumping and the further treatment of the pulp. The fluidizing is understood to mean breaking the pulp pieces in the fiber suspension into smaller parts to such an extent that the pulp starts behaving as a fluid. The fluidizing is effected by the blades of a rotor located inside the relatively long suction duct of the pump, which blades are located essentially at a radial plane and mainly axially, although some solutions have utilized rotor blades that are twisted to some extent. In all presented pump solutions the separation of gas is effected due to centrifugal force into the hollow center of the rotor in front of the impeller, wherefrom the gas is further removed through openings in the back plate of the impeller in most cases by means of suction created by a vacuum pump. Said suction or vacuum pump, most usually a so-called liquid ring pump, is located either separately from the actual centrifugal pump in connection with a drive of its own or alternatively on the same shaft with the centrifugal pump. As examples of the latter case, e.g. U.S. Pat. Nos. 5,078,573, 5,114,310, 5,116,198, 5,151,010 and 5,152,663 may be mentioned.

About the constructional details of prior art MC™ pumps it may be stated that in all said publications the rotor extends to some extent into the pulp-containing space. Most explicitly this has been described in U.S. Pat. No. 4,637,779, in which the rotor is mentioned to be extending into the tank for about 3 inches, i.e. about 75 mm. This dimension is really true as a maximum range, because the production program mainly includes pumps, the rotor of which does not extend even so deep into the suction chamber. The maximum dimension may be said to be about 0.5*the diameter of the suction duct, which ratio in reality is diminished as the diameter of the suction duct is increased. In practice, the diameter of the smallest MC™ pump is about 150 mm, whereby said ratio is fulfilled. As the diameter of the suction duct further increases, the factual extension of the rotor into the pulp chamber practically does not increase.

Because it was seen from practice, that said extension of the rotor into the chamber was not enough, U.S. Pat. No. 4,971,519 was made to protect a solution, in which the fluidizing rotor was made to extend into the chamber to an extent of at least the length of the diameter of the suction opening of the pump. In an embodiment described in said patent, the end of the fluidizing rotor was provided with blades feeding pulp towards the suction opening of the pump, by which blades a relatively large zone of moving pulp was effected in the vicinity of the suction opening in order to ensure that the pulp would not easily arch in the vicinity of the suction opening.

Now that a lot of practical experience has been gained on said MC™ pumps it has been noticed that the pumps working as such excellently and reaching at their best the consistency ranges up to about 15% can be developed further. The main consumption at the initial stage of developing the MC™ pumps was that the biggest obstacle of pumping a thick pulp is the friction between the wall of the suction duct and the pulp, which friction was attempted to be eliminated by fluidizing the pulp in the suction duct. A second problem was considered to be the discharge of the pulp from the suction chamber or drop leg into the suction duct, because the thick pulp gradually tends to fill the openings surrounded by sharp edges, i.e. including the suction opening. As a result, the fluidizing rotor was decided to be arranged to extend to a certain length into said chamber in order to make the rotor tear off the fibers and fiber flocs possibly attached to the edges of the openings and thus prevent the clogging of the suction opening. However, the old rules self-evident to a designer of centrifugal pumps were maintained, according to which rules the flow of the material being pumped has to be as laminar as possible when entering the pump to eliminate flow losses. References of this kind are still found, e.g. in said U.S. Pat. No. 4,637,779 wherein on column 2, pages 24–30 it is stated that a prior art apparatus generates in front of and around the suction inlet of the pump a "doughnut-shaped" turbulent, i.e. at least partly fluidized, zone which really is located in the vicinity of the edges of the suction inlet of the pump. In said US-publication said phenomena has been considered to disturb the pumping, believing in rules on pump design, and accordingly the tips of the rotor blades extending into the pulp chamber or the like of the MC™ pump have been twisted to give the pulp a force component acting towards the suction inlet. In the publication the utilization of said solution is based on giving the pulp flowing inwards a pressure that facilitates the removing of gas in front of the impeller.

The next confronted problem was the one familiar from pumping pulps of medium consistency by means of MC™ pumps, i.e. even if the pump and its rotor were capable of treating the pulp in the suction duct and further therefrom with adequate efficiency, the problem experienced at consistencies high enough is the getting of the pulp from the pulp chamber or the like into the suction duct. Reasons for this problem are both the arching of the pulp in the pulp space, i.e. the forming of an empty arch-like space in front of the suction inlet of the pump, and the friction between the pulp and the walls of said space, which friction retards the downward flow of the pulp.

Attempts were made to develop the pump according to said U.S. Pat. No. 4,971,519 further to a better direction, because it was noticed that although pulp was no longer arching in front of the pump, the efficiency of the pump was relatively low. As a solution to said problem, U.S. Pat. No. 4,877,368 presented a suction arrangement of a pump wherein there was a screw flight arranged either outside the fluidizing rotor blades of the fluidizing rotor, in the suction duct of the pump or both. The purpose of said flight when attached onto a rotating rotor was to actively feed the pulp towards the impeller of the centrifugal pump, and when attached to the wall of the suction duct to passively guide the pulp flow rotating in the suction duct towards the impeller. Said solution is structurally complicated. It has both essentially axially located fluidizing rotor blades and, in certain embodiments, a flight located on the blades. In other words, producing the rotor as a casting is practically almost impossible.

Experiments of the solution according to said U.S. Pat. No. 4,877,368 have, nevertheless, shown that the development is proceeding to a right direction. But said solution has further disadvantages in addition to a highly complicated and expensive production. As the pitch of the screw arranged on the fluidizing rotor was constant, the pump proved to be very sensible to changes in the volume flow or the rotational speed of the pump. Further, mainly due to said sensibility, it was found out that said pump was applicable to the treatment of pulp at a relatively low consistency only. In practice the upper consistency limit for the pulp was noticed to be about 10 percent, which is too low for almost all applications of the MC™ pumps. Due to said reasons, among others, the pump has never been actively marketed.

The starting point for the next generation high consistency pulp pumps was decided to be the solving of problems described above in such a way that it shall be possible to produce the impeller of the pump by casting and that the pump shall be suitable for pumping volume flows of various amounts at various rotational speeds and that the consistency of the pulp being pumped by said pump shall be essentially higher than 10%. In the experiments performed, a screw-like fluidizer was decided to be used, the pitch of which was changing essentially along the whole length of the screw.

Certainly prior art knows also pumps wherein the pitch of the flight located in front of the impeller of the pump and attached thereto is altering. Mostly these kind of devices are called inducers.

U.S. Pat. No. 4,275,988 deals with a centrifugal pump, in front of the impeller of which there is a screw-like means attached. Said means is formed of a shaft arranged as an extension of the hub of the impeller, to which shaft the flight is attached. The objective of said screw-like means is to increase the suction capability of the pump either with high-speed pumps or in situations where the suction head of the pump is low. As examples of applications for use, e.g. chemical and petrochemical industries are mentioned. The main problem is considered to be the high cavitation susceptibility of known pumps as well as great pressure fluctuations in the suction and pressure ducts. The starting point in said publication is that according to the principle of geometrical equality, the diameter and pitch of said screw-like feeding apparatus have to change in the same ratio. In other words, as the diameter of the screw doubles, the pitch must also double. The publication presents a number of various embodiments to fulfill said initial requirement. The solutions presented in the publication are also characterized in that the rotor is in no way dimensioned in correspondence to the suction duct, but only the diameter and the pitch of the rotor are mutually adjusted as described before. The result is that with a small rotor diameter, the distance between the rotor and the suction duct wall is relatively long. That questions the feeding effect of the rotor, especially with stiff materials, as the rotor only opens a cavity in the stiff material without forcing it to flow into the suction duct and therefrom to the pump.

CH patent publication 606 804 also deals with a centrifugal pump with a screw-like feeding member arranged as an extension of the impeller. In this case, also, the flights of the member have been attached onto the shaft functioning as an extension of the hub of the impeller. The different embodiments of the publication present several various feeding member constructions. These are all characterized in that they are completely located inside the suction duct of the pump and in that they leave a relatively long free zone between themselves and the impeller, to which zone neither the rotor nor the impeller extends. Further, concluding from the solutions of the publication, the distance between the rotor and the suction duct of the pump is not essential for said devices, because e.g. FIGS. 5 and 7 of the publication illustrate a rotor with a remarkably small diameter. In addition to that, the solutions of the publication present that the rotor part may be provided with screws with a pitch of two different orders of magnitude (FIGS. 6 and 7). The publication is concentrated especially on methods of decreasing the noise caused by these so-called inducers, particularly at partial pump loading.

To put it differently, prior art inducer solutions utilizing a continuous flight for feeding a medium to a centrifugal pump, always comprise a shaft located on the axis of the suction duct of the pump which shaft naturally closes the center of the suction duct. This kind of solution is not the best possible one for pumping a medium containing gas or material easily changing into a gas-like condition (vaporizing) (e.g. hot water), because the existing shaft prevents effective separation of gas or vapor into the center of the flow. Thus it is clear that said prior art pumps have never been presented for pumping a liquid containing gas-like material, but for pumping liquid only. This becomes obvious, among other things, from the fact that in no prior art pump with this kind of closed inducer with a closed center, the impeller is provided with openings for gas-removal.

The objective of the present apparatus and method according to the invention is to solve at least part of said problems disturbing prior art pumps. As some characterizing features of the invention e.g. the following may be mentioned:

- in a preferred embodiment a fluidizing rotor with an open center,
- a separation arrangement for gas and/or vapor in connection with the rotor and/or the impeller,
- fluidizing rotor blades, the pitch of which changes essentially evenly essentially on the whole length of the rotor, and
- a clear gap between the rotor and the suction duct.

The method and apparatus according to the invention are well suitable for pumping various liquids. As examples of these mediums at least the following are worth mentioning: gas-containing pulps (e.g. fiber suspensions of the wood processing industry), especially hot pulps, process filtrates, chips, other easily vaporizing liquids of the cellulose, sugar and food industry and different hot liquids. In addition to that, the method and apparatus according to the invention have made it possible to pump all said mediums at a higher temperature than before.

The method of pumping a gas-containing and/or viscous material according to the invention by means of an apparatus mainly comprising a casing, suction and discharge ducts therein, an impeller including at least one or more pumping vanes and a rotor arranged in front of the impeller, which rotor further comprises one or more blades, in which method said material is made to flow into the pumping apparatus through said suction duct, the material is discharged into the discharge duct, is characterized in that at the beginning part of the suction duct, viewing from the impeller at its further end, the pressure of the pulp is raised in order to feed the pulp into the apparatus.

The apparatus according to the invention for pumping a gas-containing and/or viscous material, which apparatus mainly comprises a casing, suction and discharge ducts therein, an impeller comprising at least one or more pumping vanes, and a rotor arranged in front of the impeller, which rotor further comprises one or more blades, is characterized in that the blades of said rotor have been twisted so that their pitch changes along an essential part of the length of the rotor.

The rotor according to the invention for use in connection with an apparatus mainly comprising a casing, suction and discharge ducts therein and an impeller having at least one or more pumping vanes for pumping a gas-containing and/or viscous material, which rotor comprises one or more blades, is characterized in that the blades of said rotor have been twisted so that their pitch changes along an essential part of the length of the rotor.

Other characterizing features of the method and apparatus according to the invention are disclosed in the appended claims.

BRIEF DESCRIPTION OF THE DRAWINGS

In the following, the method and apparatus according to the invention are explained with more detail with reference to the appended figures, of which

DESCRIPTION OF THE INVENTION

Figure 1:
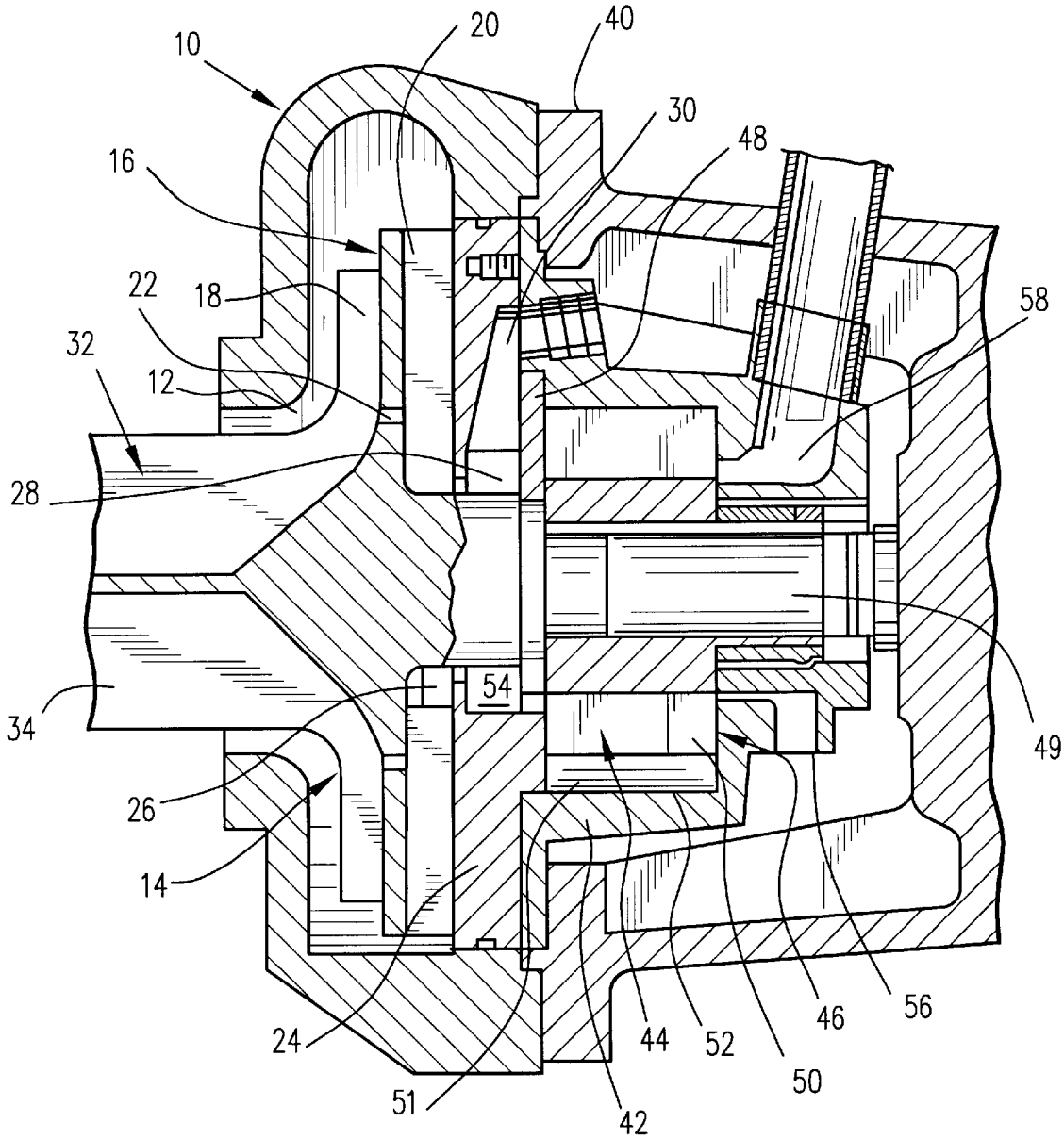
FIG. 1 (PRIOR ART)
FIG. 1 illustrates a prior art MC-pump in an axial cross-sectional view.

According to FIG. 1, a prior art centrifugal pump comprises a spiral casing 10 and a pump body 40. The spiral casing 10 comprises the suction inlet 12 of the centrifugal pump and an essentially tangential discharge opening (not shown). The spiral casing surrounds the half-open impeller 14 of the centrifugal pump, which impeller comprises a so-called back plate 16, pumping vanes 18 attached to its surface on the side of the suction opening 12, the so-called front surface, and a fluidizing rotor 32 preferably comprising blades 34 extending to a distance from both the axis of the pump and the wall of the suction inlet 12, and back vanes 20 attached to the backside surface of the back plate 16. The back plate 16 of the impeller 14 is further arranged to have gas-removal openings 22. Between the spiral casing 10 and, in this constructional embodiment, a vacuum pump arranged inside the pump body 40 there is arranged, preferably detachably, a back wall 24 of the pump, which back wall leaves between itself and the shaft or, as shown in the figure, a cylindrical shoulder extending from the impeller, a gas-removal duct 26 extending in this embodiment to form an annular chamber 28 for leading the gas from the spiral casing of the centrifugal pump into the vacuum pump. With reference to the pump described before it has to be noticed that said pump is only an example of prior art. The only connection between it and the pump according to the present invention is that in our invention we present a new type of rotor which may replace e.g. the rotor of the described prior art pump. Thus it is also clear that the rotor according to our invention may be connected with any kind of centrifugal pump, either of prior art or one provided with new solutions.

Figure 2:
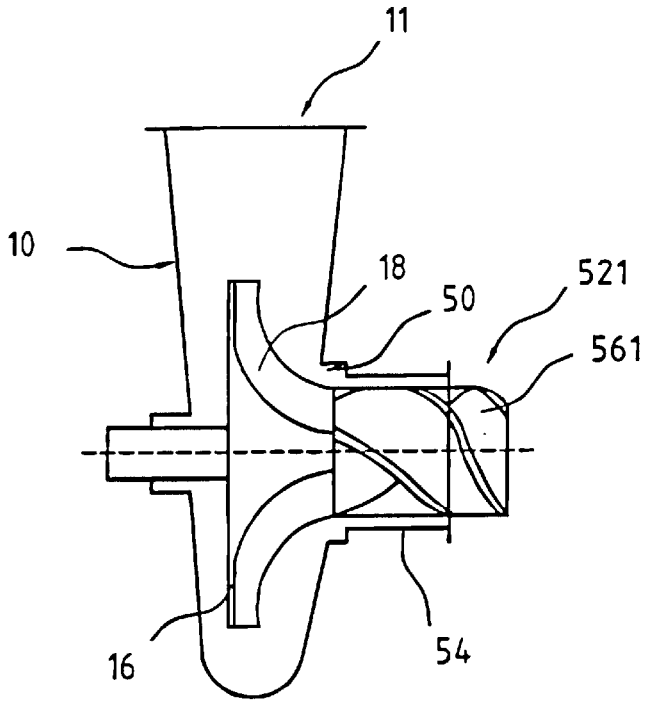
FIG. 2 illustrates a centrifugal pump according to a preferred embodiment of the invention in an axial cross-sectional view.

In the embodiment according to FIG. 2, e.g. the half-open impeller 14 arranged inside the casing 10 of the centrifugal pump according to FIG. 1 is replaced with an also half-open impeller 50 according to a preferred embodiment of the invention, which impeller may otherwise correspond to prior art except for the rotor 52. Thus, in the embodiment of the figure the impeller of the pump comprises in a conventional way a back plate 16 of the impeller, which by no means is always necessary in a centrifugal pump, pumping vanes 18 arranged on its surface and a rotor 52 (the reference number of a rotor in general is 52, individual rotors in different figures are usually referred to with numbers 521–526) extending out of said back plate 16 towards the suction duct 54 of the pump. Further, if the pump has to be gas-separating, the back plate 16 of the impeller 50 may be provided with gas-removal openings and possibly with back vanes, too. A second gas-removal method is naturally to arrange devices for gas-removal in connection with the rotor 52. This is performed e.g. so that in some zone of the rotor with a lower pressure, on the foot zone of a blade, i.e. in connection with the backside surface of the blade when viewed from the rotational direction, or in the vicinity of the axis of the rotor a gas-removal opening is arranged, through which the gas may be removed depending on the pressure conditions either with vacuum providing means or without them the same way as from a gas-removal apparatus arranged in connection with the impeller 50. Said gas-removal opening may lead further e.g. through a channel arranged in a rotor blade and/or a channel arranged via the shaft of the rotor. The rotor 52 preferably extends to the whole length of the suction duct 54 of the pump. In some applications, however, such as the embodiment according to FIG. 2, the rotor 521 extends clearly outwards from the suction duct 54, at least to the length of half of the diameter of the suction duct 54, preferably at least to the length of the whole diameter of the suction duct 54. In the embodiment of the figure, the blades 56 (the rotor blades in general are referred to under reference number 56; individual rotor blade solutions are referred to under reference numbers 561–566) are formed of three flights, the pitch of which changes essentially evenly from the tip part of the rotor 521 towards the impeller 50. In the embodiment of the figure, said blades 561 are so wide that they extend up to the axis of the rotor 521, thus leaving no open space in the center of the rotor 521, but extending the effect of the blades 561 of the rotor 521 compulsorily to the very center of the rotor 521. The screw pitch of the blades 561 is at its smallest at the tip part of the blades farthest from the impeller 50.

Figure 3:
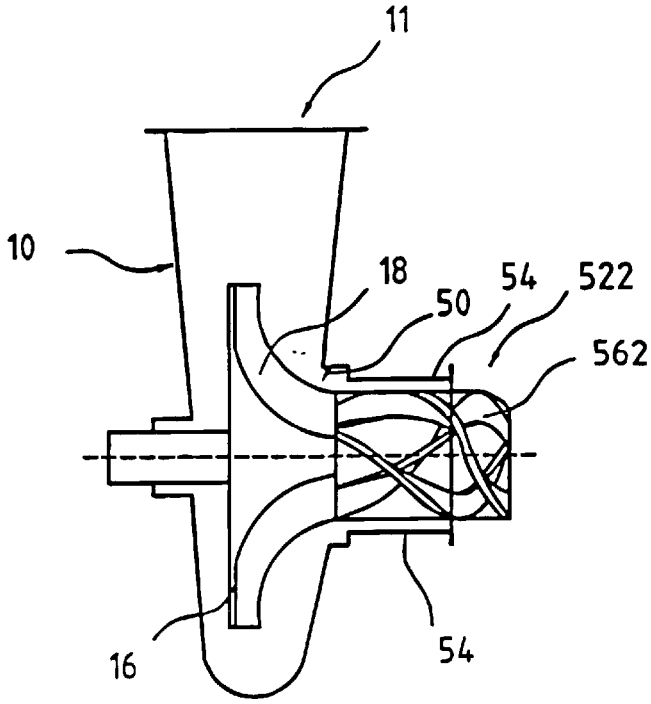
FIG. 3 illustrates a centrifugal pump according to a second preferred embodiment of the invention in an axial cross-sectional view.

FIG. 3 illustrates a pump solution according to a second preferred embodiment of the invention closely resembling that of FIG. 2. There is the difference, however, that the rotor 522 is formed of three blades 562 essentially narrower than the blades of the rotor of FIG. 2. In the embodiment of FIG. 3, the blades 562 leave in their middle an open center, in a way like prior art rotor blades of the so-called MC-pumps. According to one additional embodiment, the rotor blades are in applicable parts extensions of the vanes of the impeller both in this embodiment and in other embodiments. Just as in the embodiment of FIG. 2, also when the rotor of this embodiment is operating, there may in applicable conditions (gas-containing or easily vaporizing/gasifying liquid or suspension) separate gas that may to an applicable extent be removed by the methods described already in connection with the previous figure. Accordingly, it is clear that the rotor blades need not necessarily correspond to FIGS. 2 or 3 only, but they may also be touching each other along a part of their length and apart from each other along a part of their length leaving an open space in the center of the rotor.

Figure 4:
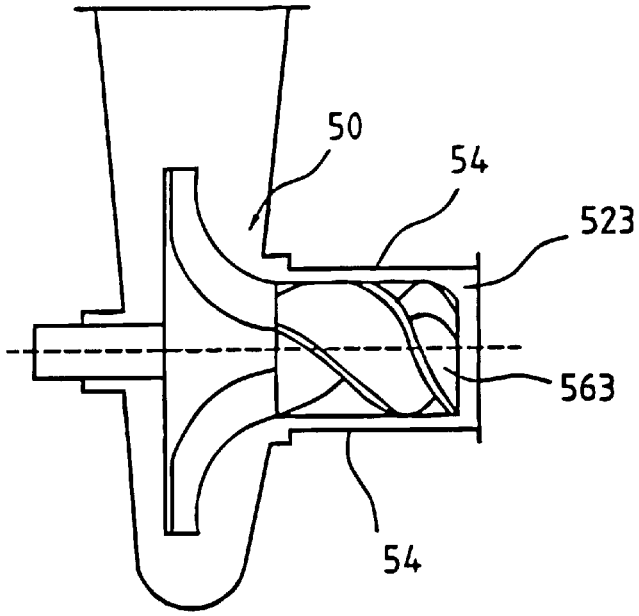
FIG. 4 illustrates a centrifugal pump according to a third preferred embodiment of the invention in an axial cross-sectional view.

FIG. 4 illustrates a pump solution according to a third preferred embodiment of the invention also closely resembling the embodiment of FIG. 2. Unlike in FIG. 2, in this embodiment the rotor 523 does not extend in the longitudinal direction outside the suction duct 54, but the rotor 523 remains completely inside the suction duct 54. Naturally, the rotor blades 563 may, except from being touching each other in the center of the rotor, also leave the center of the rotor open according to FIG. 3. The gas-separation may also be arranged e.g. in the way described earlier.

Figure 5:
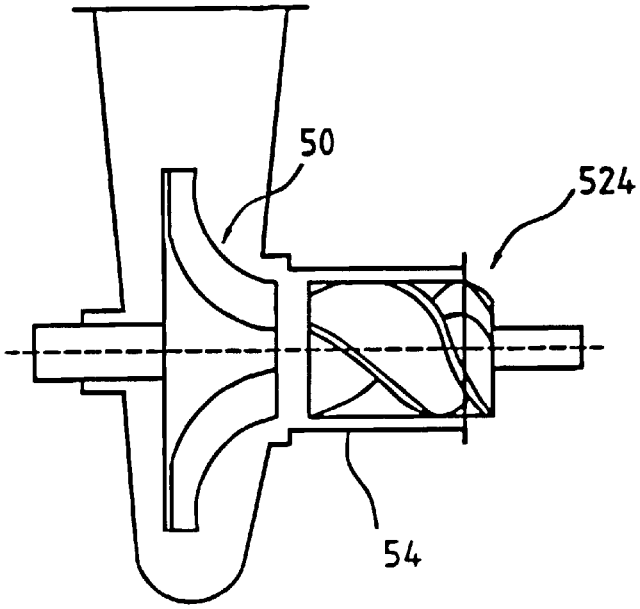
FIG. 5 illustrates a centrifugal pump according to a fourth preferred embodiment of the invention in an axial cross-sectional view.

FIG. 5, in its turn, illustrates a pump solution according to a fourth preferred embodiment of the invention clearly different from all earlier embodiments. Unlike all earlier embodiments, in which the rotor 52 was fixed on the shaft of the pump either directly or through the impeller 50 of the pump, the rotor 524 has been arranged to have a drive of its own (not shown). The shaft of the rotor 524 is in the embodiment of the figure, although not necessarily, congruent with the shaft of the impeller 50. In this embodiment, too, the blades of the rotor 524 may be of the narrow or wide (shown in the figure) version, depending on the application and special purpose. The rotor 524, though being independent, may be provided with gas-separation means, if necessary, at applicable parts exactly according to the previous embodiments. Said rotor 524, which might also be called a feeding device, may be positioned e.g. to the bottom part of a drop leg or in a tube elbow leading to a pump, to feed a medium to the pump. Although the figure shows that the rotor 524 extends inside the suction duct 54 of the pump, it is completely possible that said suction duct is replaced by a suction tube separate from the pump, acting as rotor casing. Said rotor casing may also be a structural part of the apparatus marketed together with the rotor, whereby according to a preferred embodiment said casing is open from the upper side, in which case it is possible to attach to the casing e.g. a pulp drop leg or the like.

Figure 6:
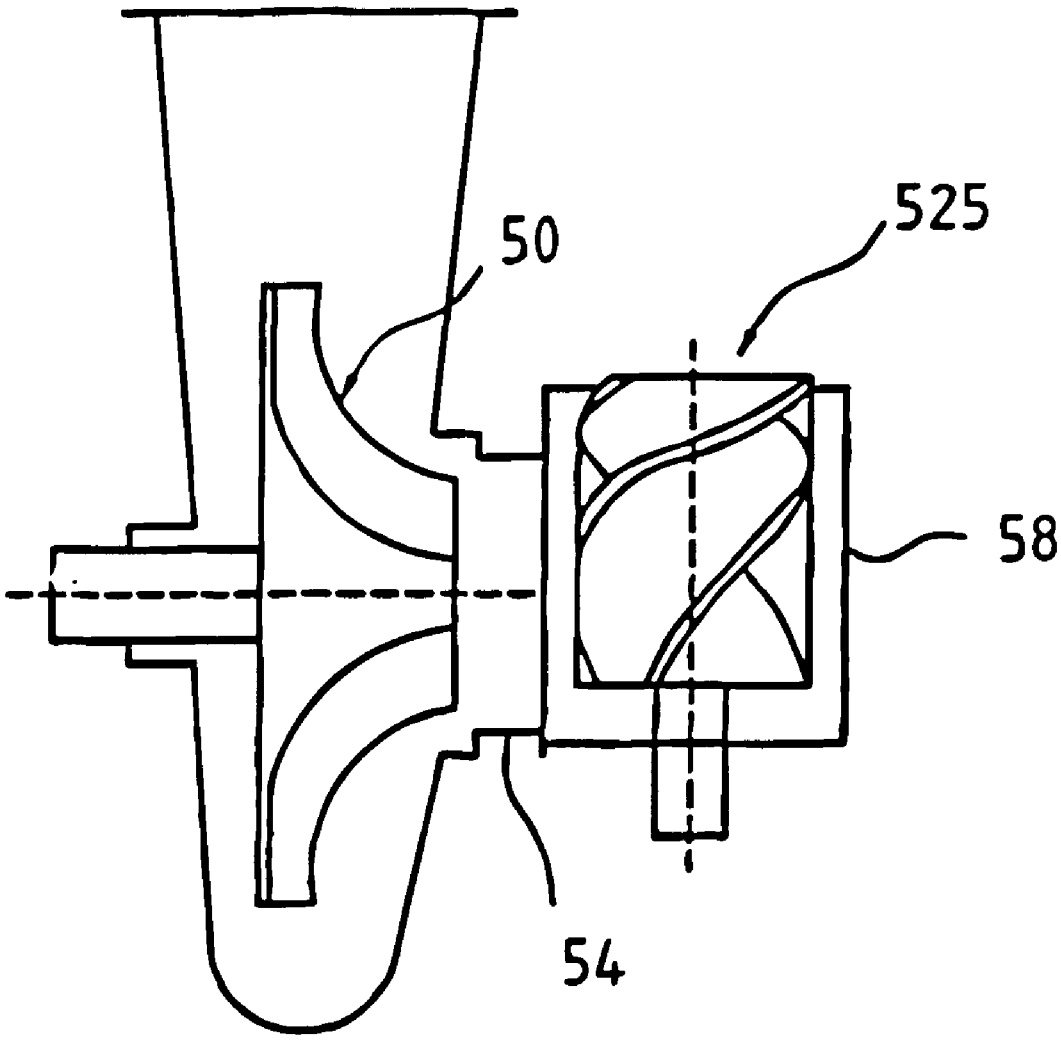
FIG. 6 illustrates a centrifugal pump according to a fifth preferred embodiment of the invention in an axial cross-sectional view.

FIG. 6 illustrates a pump solution according to a fifth preferred embodiment of the invention, in which the rotor 525 is provided with a drive of its own and further arranged at an angle with respect to the axis of the impeller 50. In addition, it may be noted from the illustrated constructions that in FIG. 6 the rotor 525 is surrounded by a casing 58. In other words, the solution according to FIG. 6 is applicable e.g. so that the casing 58 of the rotor extends upwards having either the same or a different diameter and forms together with e.g. the discharge screw of the washer a discharge arrangement for pulp being discharged from the washer. Naturally the casing 58 may be either the same piece with the suction duct 54 of the pump or at least attached thereto. It is obvious that the described apparatus may be located in many other applications, too, where pulp is discharged through a diameter-restricted space to the pump. In these embodiments, too, the rotor blades may be touching each other, partly apart or totally apart from each other, whereby they leave the rotor an open center e.g. for the purpose of gas-separation.

The rotor casing itself, when existing, may be either a symmetrical tube or cone, or it may also be non-symmetrical. It is e.g. quite possible that there is arranged, preferably at the final end, a part resembling the volute of a centrifugal pump, by means of which the feed pressure of the apparatus may be slightly increased.

In the experiments we have performed we have noticed that with the pulp used in the experiments, with its gas-content and thickness, the best result is achieved using a rotor having a flight pitch of the blade in the beginning of about 200 mm and increasing in the vicinity of the impeller up to 3600 mm. The same experiments have also revealed that the pitch of the flight has to be increasing almost up to the impeller, although just in front of the impeller even pure production-technical reasons alone cause the need to be prepared to leave a portion of the rotor blades of about 10 percent of the length of the rotor to be freely formed. Reference test runs less detailed have shown that the pitch of the flight should increase on the length of the fluidizer at least five-, preferably ten-fold. The test runs have also shown that the increase of the flight pitch should preferably be evenly continuing, but that a change in the pitch in more, at least not less than three stages, may also be considered functionally acceptable.

Further our experiments have shown that the distance of the rotor blades from the suction duct wall essentially effects the operation of the apparatus. Thus, for example in the case of fiber suspensions of the wood processing industry, the distance of the blades 56 from the suction duct wall should be, naturally depending on the consistency of the pulp and the whole diameter of the suction duct, in the range of 5–50 mm.

The apparatus according to the invention functions as an example in pumping the fiber suspensions of the wood processing industry so that the rotor very efficiently cuts with its tip portion part of the pulp either in the pulp chamber, drop leg or flow tube and starts to transfer it towards the impeller of the pump. To put it differently, by its tip portion the rotor functions as an independent screw pump. Unlike the so-called MC-pumps of prior art, in which the only purpose of the rotor was to fluidize the pulp and in which the flow of the pulp from the whole length of the rotor to the impeller was effected by the suction caused by the pump. Thus, the rotor according to our invention creates a pressure by means of which the pulp is transferred towards the impeller of the pump. In the apparatus according to our invention, when approaching the impeller, the feeding and pressure-increasing effect of the rotor becomes less significant, because the suction caused by the impeller of the pump and the moving speed generated in the pulp by the rotor as such cause the pulp to flow to the pump. At the same time, also in practical pumping situations it becomes necessary to calm down the moving of the pulp in the suction duct so that gas may separate from the pulp into the center of the impeller. Even though the feeding rotor decreases the need for gas-separation in view of the actual pumping, as the pressure-increasing effect of the rotor decelerates the separation of the gas from the pulp, separating the gas from the pulp is in most cases desirable for process-technical reasons. So, for said reason there is arranged in front of the half-open impeller of the pump a longitudinal zone in the rotor, in which zone the pitch of the rotor blades is very big. Said zone functions as an efficient gas-separator, whereby the gas separated into the center of the impeller is easy to remove through the gas-removal openings of the impeller to the backside space of the impeller and further preferably by means of a liquid ring pump arranged either on the same shaft with the impeller or separately from the pump with a drive of its own.

In addition to the pulps of the wood processing industry, the method and apparatus according to our invention are excellently applicable to pumping many other mediums as well. One preferable application is the pumping of hot liquids near their boiling point. In this kind of cases the rotor, when increasing the pressure of the liquid in the suction duct and ensuring that the pressure stays high enough in the suction duct, prevents the liquid from boiling in the pump. In that way the rotor according to our invention facilitates the pumping of liquids at a temperature near the boiling point.

As noticed from the aforesaid, the method and apparatus according to our invention eliminate many problems of prior art apparatus and processes. Furthermore, the apparatus according to our invention facilitates in some applications the use of more simple pumping solutions compared to the ones used earlier. From what has been stated above one has to remember, though, that it represents only a few preferable embodiments of the invention without trying to limit the invention to said embodiments only. That is, even though all described examples represent a rotor with three blades, the number of blades may vary depending on the situation so that the minimum number of blades may be one. Further it has to be noted that the word gas-containing is also understood to mean a medium easily gasifying and vaporizing, e.g. hot water in the fiber suspensions of the wood processing industry or some oil products.

What is claimed is:

1. A method of pumping a gas-containing and viscous material with a pumping apparatus comprising a casing, suction and discharge ducts therein, an impeller further comprising at least one or more pumping vanes, and a rotor arranged in front of the impeller, which rotor further comprises one or more blades each having an increasing pitch in a direction towards the impeller, wherein said method comprises:

introducing material to flow to the pumping apparatus through said suction duct;

rotating the one or more blades of the rotor to move the material through the suction duct and to the impeller, and discharging the material from said pumping apparatus to the discharge duct;

wherein the increasing pitch of the one or more blades of the rotor increases a pressure of the material as the material is moved by the blades towards the impeller, and at a final part of the suction duct adjacent the impeller the rotor subjects the material to centrifugal force in order to separate gas from the material.

2. A method according to claim 1, wherein in the suction duct pressure generated by the rotor is maintained to prevent vaporization of the material in the suction duct.

3. A method according to claim 1, wherein gas is separated from the material in a final part of the suction duct.

4. An apparatus for pumping a gas-containing and viscous material comprising:

a casing housing a suction duct, a discharge duct, an impeller comprising at least one or more pumping vanes, and a rotatable rotor arranged in front of and immediately upstream of the impeller, which rotor further comprises one or more blades wherein each blade is twisted so that a pitch of the blade changes along a length of the rotor, wherein said apparatus further comprises a gas-separation zone proximate to the impeller, and said pitch of the blades of the rotor is increased towards said gas-separation zone such that in said zone the blades subject the material to centrifugal force for separating gas from the material.

5. An apparatus according to claim 4, wherein the impeller further comprises a back plate and gas-removal openings arranged in said back plate.

6. An apparatus according to claim 4, further comprising gas-removal openings arranged in connection with the rotor.

7. An apparatus as in claim 4 further comprising a gap between the impeller and rotor of not greater than ten percent of a length of the rotor.

8. An apparatus for pumping a gas-containing and viscous material comprising a casing, suction and discharge ducts therein, an impeller comprising at least one or more pumping vanes, and a rotatable rotor arranged in front and immediately upstream of the impeller, which rotor further comprises one or more blades and each of said blades having a pitch increasing along the length of the rotor, and said apparatus further comprising, in the vicinity of the impeller, a gas-separation zone, wherein said pitch of said one or more blades of the rotor increases towards the impeller.

9. An apparatus according to claim 8, wherein said pitch of said one or more blades of the rotor increases in steps of increasing pitch along a length of the blades.

10. An apparatus according to claim 8, wherein said pitch of said one or more blades of the rotor increases continuously.

11. An apparatus as in claim 8 further comprising a gap between the impeller and rotor of not greater than ten percent of a length of the rotor.

12. An apparatus for pumping a gas-containing and viscous material comprising a casing, suction and discharge ducts therein, an impeller comprising at least one or more pumping vanes, and a rotatable rotor arranged in front of and immediately upstream of the impeller, which rotor further comprises one or more blades each being twisted so that a blade pitch changes along a length of the rotor, and said apparatus further comprising, in the vicinity of the impeller a gas-separation zone, in which said pitch of said one or more blades of the rotor alters to at least five-fold.

13. An apparatus as in claim 12 further comprising a gap between the impeller and rotor of not greater than ten percent of a length of the rotor.

14. An apparatus for pumping a gas-containing and viscous material comprising a casing, suction and discharge ducts therein, an impeller comprising at least one or more pumping vanes, and a rotatable rotor arranged in front of the impeller, said rotor further comprises one or more blades twisted so that a pitch of each blade changes along a length of the rotor, and said apparatus further comprising, in the vicinity of the impeller, a gas-separation zone in which said pitch of said one or more blades of the rotor alters at least ten-fold.

15. An apparatus as in claim 14 further comprising a gap between the impeller and rotor of not greater than ten percent of a length of the rotor.

16. A rotatable rotor for use an apparatus comprising a casing, suction and discharge ducts therein and an impeller having at least one or more pumping vanes for pumping a viscous and gas-containing material, said rotor comprising:

a tip portion at an end of the rotor and an other end of the rotor facing and adjacent the impeller, said rotor further comprising one or more blades twisted so that a pitch of each blade varies along a length of the rotor, wherein said pitch of said one or more blades of the rotor is increased from said tip portion of the rotor towards said other end of the rotor to form a gas separation zone along the rotor.

17. A rotor according to claim 16, wherein said pitch of the blades of the rotor is greatest at the other end of the rotor facing the impeller.

18. An apparatus as in claim 16 further comprising a gap between the impeller and rotor of not greater than ten percent of a length of the rotor.

19. A rotatable rotor in an apparatus comprising a casing, suction and discharge ducts therein, and an impeller having at least one or more pumping vanes for pumping a viscous and gas-containing material, said rotor further comprising one or more blades twisted so that a pitch of each blade varies along a length of the rotor, said pitch being greatest at an end of the rotor adjacent the impeller, wherein the pitch of the one or more blades of the rotor alters at least five-fold.

20. A rotor according to claim 19, further comprising a casing housing the impeller and rotor, and the gas-separation zone is arranged at said end of the rotor adjacent the impeller.

21. A rotor according to claim 19, encircled at least along a part of the length of the rotor by the suction duct of said apparatus, and the gas-separation zone arranged at said end of the rotor adjacent the impeller.

22. A rotor according to claim 19, wherein said rotor is surrounded at least along a part of the length of the rotor by the suction duct, and said impeller further comprises gas-removal openings to lead gas away from the gas-separation zone of the rotor.

23. A rotatable rotor in an apparatus comprising a casing, suction and discharge ducts therein, and an impeller having at least one or more pumping vanes for pumping a viscous and gas-containing material, said rotor further comprises one or more blades being twisted so that a pitch of each blade varies along a length of the rotor, said pitch of the blades of the rotor being greatest at an end of the rotor adjacent the impeller, and said blades with varying pitch forming a gas-separation zone in the rotor and said rotor further comprising gas-removal openings.

24. An apparatus as in claim 23 further comprising a gap between the impeller and rotor of not greater than ten percent of a length of the rotor.

25. A method of pumping a gas-containing and viscous material with a pumping apparatus comprising a casing having a suction duct and a discharge duct, an impeller, and a rotor arranged in the suction duct upstream of the impeller, wherein the rotor has at least one helical blade having a pitch which increases along an axis of rotor and in a direction towards the impeller, wherein the method comprises:

introducing the material into a front portion of the rotor;

rotating the at least one blade of the rotor to move the material through the rotor, suction duct, and to an inlet of the impeller;

suppressing vaporization of the material in the front portion of the rotor due to a shallow blade pitch and the rotation of the rotor which at least maintains a pressure of the material in the front portion of the rotor;

separating gases from the material in a rear portion of the rotor by increasing the blade pitch in the rear portion and applying centrifugal forces to the material by the rotation of the rotor;

directing the material in the rear portion of the rotor to the impeller;

allowing the separated gases in the material to vent out of the material, and discharging the solids in the material from the impeller through the discharge duct.

26. A method as in claim 25 wherein the rear portion of the rotor is housed in a suction duct and the front portion of the rotor extends out of the suction duct.

27. A method as in claim 26 wherein the viscous material is a fiber suspension.

28. A method as in claim 25 wherein the rear portion of the rotor discharges directly into the impeller and the impeller adjacent the portion of the rotor.

29. A method as in claim 25 wherein the blade pitch increases at least five-fold along a length of the rotor.

30. A method as in claim 25 wherein the blade pitch increases at least ten-fold along a length of the rotor.

31. A gas separator for a viscous material comprising:

a casing housing an impeller;

a rotatable rotor having a discharge adjacent the impeller and an inlet adapted to receive the viscous material;

at least one blade on the rotor having a blade pitch defined by an angle between a surface of the blade and a plane perpendicular to a rotor axis, wherein the blade pitch increases along a length of the rotor and in a direction towards the rotor discharge;

a suction duct housing a rear portion of the rotor and attached to the casing, wherein said suction duct and rotor define a vapor separation region, and a front portion of the at least one blade having a shallow blade pitch to suppress vaporization of the fluid in the front portion.

32. A gas separator as in claim 31 wherein the front portion of the rotor extends out of the suction duct.

33. A gas separator as in claim 32 wherein the discharge of the rotor discharges directly into a the impeller.

34. A gas separator as in claim 32 wherein the discharge of the rotor is separated from an inlet of the impeller by a gap of no greater than ten percent of the length of the rotor.

35. A gas separator as in claim 31 wherein the front portion extends out of the suction duct by at least one-half a diameter of the suction duct.

36. A gas separator as in claim 31 wherein the blade pitch increases at least five-fold along the length of the rotor.

37. A gas separator as in claim 31 wherein the blade pitch increases at least ten-fold along the length of the rotor.

* * * * *

UNITED STATES PATENT AND TRADEMARK OFFICE

CERTIFICATE OF CORRECTION

PATENT NO. : 6,551,054 B1
APPLICATION NO. : 09/869375
DATED : April 22, 2003
INVENTOR(S) : Peltonen et al.

It is certified that error appears in the above-identified patent and that said Letters Patent is hereby corrected as shown below:

Column 11, line 31, Claim 16, kindly delete "A rotatable rotor for use an apparatus comprising" and insert --A rotatable rotor for use in an apparatus comprising-- therefor.

Signed and Sealed this

Twenty-seventh Day of November, 2007

JON W. DUDAS
*Director of the United States Patent and Trademark Office*